US006768405B2

(12) United States Patent
Nishida et al.

(10) Patent No.: US 6,768,405 B2
(45) Date of Patent: Jul. 27, 2004

(54) SWITCHING DEVICE

(75) Inventors: Takeshi Nishida, Muko (JP); Yasuyuki Masui, Otsu (JP); Kozo Maenishi, Nagaokakyo (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 10/638,264

(22) Filed: Aug. 8, 2003

(65) Prior Publication Data

US 2004/0080389 A1 Apr. 29, 2004

(30) Foreign Application Priority Data

Aug. 9, 2002 (JP) ..... 2002/233188

(51) Int. Cl.[7] ..... H01H 9/00

(52) U.S. Cl. ..... 335/177; 335/136; 335/180; 335/266

(58) Field of Search ..... 335/106, 121, 335/124, 127, 132, 136, 137, 151, 154, 177–184, 266

(56) References Cited

U.S. PATENT DOCUMENTS 5,200,727 A * 4/1993 Katoh et al. ..... 335/222

FOREIGN PATENT DOCUMENTS

WO WO 95/24051 9/1995 ..... H01H/1/66

* cited by examiner

*Primary Examiner*—Ramon M. Barrera
(74) *Attorney, Agent, or Firm*—Osha & May L.L.P.

(57) ABSTRACT

A switching device of low power consumption type, in which magnetic pole portions 37*c* of a pair of iron cores 37 constructing an electromagnet block 30 are individually arranged on the bottom face of a sealing case 41. The other end portions of the paired iron cores 37 are connected to each other by a yoke 39. As the electromagnet block 30 is magnetized and demagnetized, the two end portions of a moving iron member 63 of a contact mechanism block 50 are attracted by and leave the paired magnetic pole portions 37*c* of the iron cores 37.

2 Claims, 15 Drawing Sheets

SWITCHING DEVICE

BACKGROUND OF THE INVENTION

1. Field of the Invention

The present invention relates to a switching device and, more particularly, to a switching device such as an electromagnetic relay, a switch or a timer for switching an electric current in a closed space.

2. Description of the Related Art

As the switching device for closing the electric current in the closed space, there is a closed type relay device (as referred to Patent Publication 1, for example) in the prior art.

[Patent Publication 1]

JP-T-9-510040 (on pages 13 to 17 and in FIG. 1)

As a coil portion 40 is magnetized and demagnetized, more specifically, a plunger 9 is brought into and out of contact with a core center 4 so that an armature assembly 8, as integrated with the plunger 9, and an armature shaft 10 are slit in the axial direction to bring a moving contact disc 21 into and out of contact with stationary contacts 22 and 22.

In the closed type relay device, a core assembly 2 constructing a magnetic circuit includes the core center 4, a core base upper portion 5, a core outer wall 6 and a core base portion 7, all of which are made of a ferromagnetic substance.

However, the core center 4 contacts with the core base portion 7 only through a thin bottomed cylindrical member (although not designated by numeral) but not directly. This bottomed cylindrical member is thought from the viewpoint of magnetic efficiency to be made of a nonmagnetic material. Therefore, the core assembly 2 has a high magnetic resistance so that it requires a high current for achieving a desired driving force. This raises a problem that the power consumption is high.

SUMMARY OF THE INVENTION

In view of this problem, the invention has an object to provide a switching device of a low power consumption type.

In order to achieve this invention, according to the invention, there is provided a switching device comprising: a contact mechanism block housed in a closed sealing case; and an electromagnet block arranged outside of the sealing case for driving the contact mechanism block, wherein a pair of iron cores constructing the magnetic block have their one-end magnetic pole portions individually arranged on the bottom face of the sealing case and their other end portions connected to each other by a yoke, so that the two end portions of moving iron member of the contact mechanism block are attracted by and leave the magnetic pole portions of the iron cores as the electromagnet block is magnetized and demagnetized.

According to the invention, the moving iron member of the contact mechanism block contacts with the magnetic pole portions or the one-end portions of the paired iron cores constructing the electromagnet block, and the end portions of the iron cores are connected by the yoke. As a result, a magnetic circuit, as continued by the paired iron cores, the yoke and the moving iron member, is formed to provide a switching device obtained having a low magnetic resistance and a small power consumption.

In an embodiment of the invention, moreover, neck portions formed just below the magnetic pole portions of the iron cores may be press-fitted in press-fit holes formed in the bottom face of the sealing case, and the press-fit holes may be clamped at their open edge portions between the open edge portions of cylindrical members press-fitted on the neck portions and the magnetic pole portions of the iron cores. The sealing case may be made of a material having a larger coefficient of thermal coefficient than that of the iron cores.

According to this embodiment, the sealing case is made of a material having a larger coefficient of thermal coefficient than that of the iron cores. Even if the temperature rises so that the iron cores expand, therefore, the expansion of the sealing case in the thickness direction is larger than those of the iron cores so that the open edge portion of the sealing case is firmly clamped between the magnetic pole portions of the iron cores and the open edge portions of the cylindrical members.

Even if the temperature drops so that the iron cores shrink, on the other hand, the shrinkage of the press-fit holes of the sealing case in the diametrical direction is larger than those of the iron cores so that the sealing case fastens the neck portions of the iron cores. As a result, there is obtained an effect that to provide a closed type switching device, in which the gas-tightness is not deteriorated even if the temperature changes.

DESCRIPTION OF THE PREFERRED EMBODIMENTS

Figure 1:
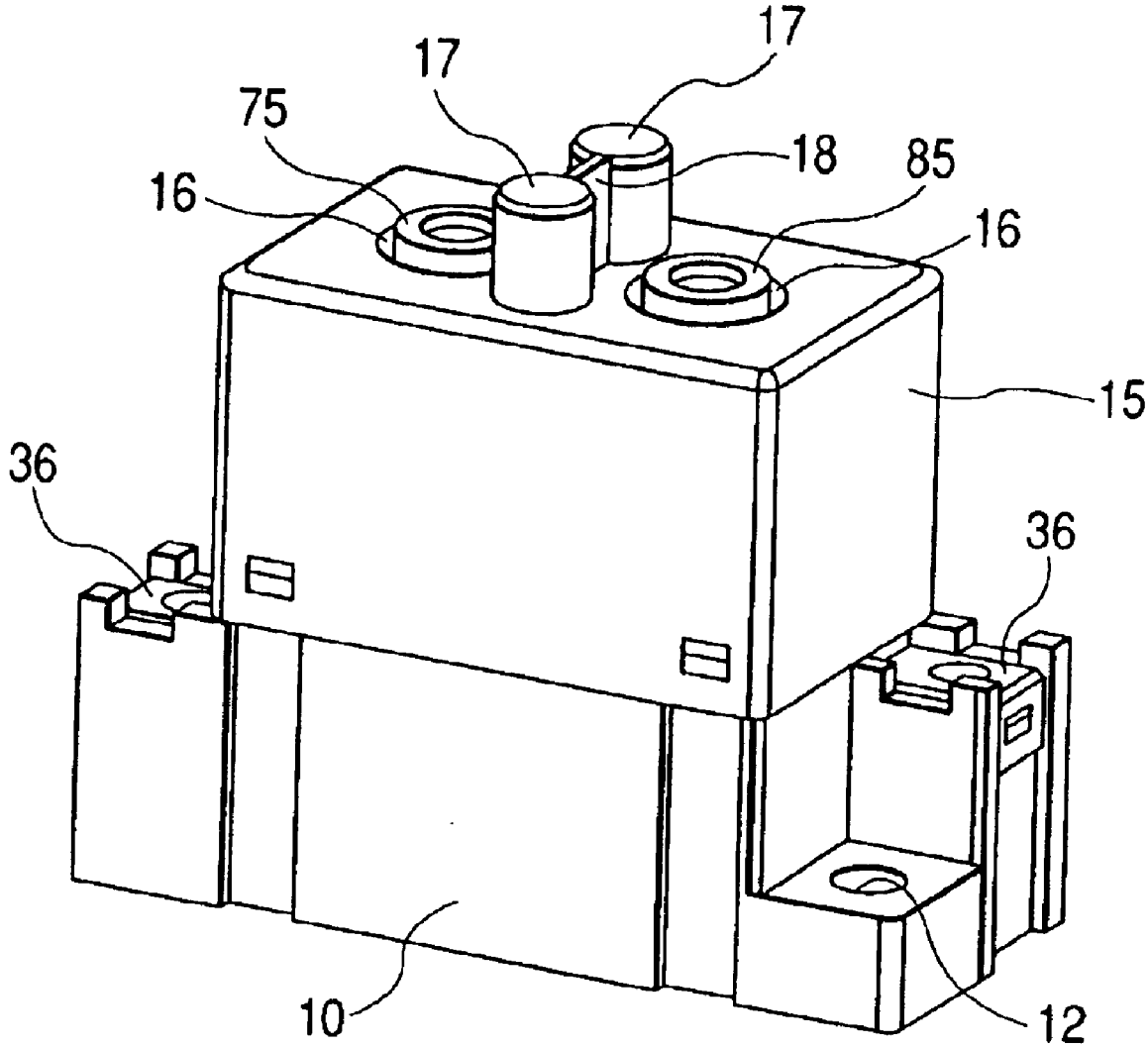
FIG. 1 is a perspective view showing an embodiment of the case, in which a switching device according to the invention is applied to a DC current breaking relay.

Embodiment according to the invention will be described with reference to FIG. 1 to FIG. 15. The first embodiment of the invention is applied to a DC load switching relay, in which a relay body 20 is housed in a space defined by a box-shaped case 10 and a box-shaped cover 15 integrated, as shown in FIG. 1 and FIG. 2.

Figure 2:
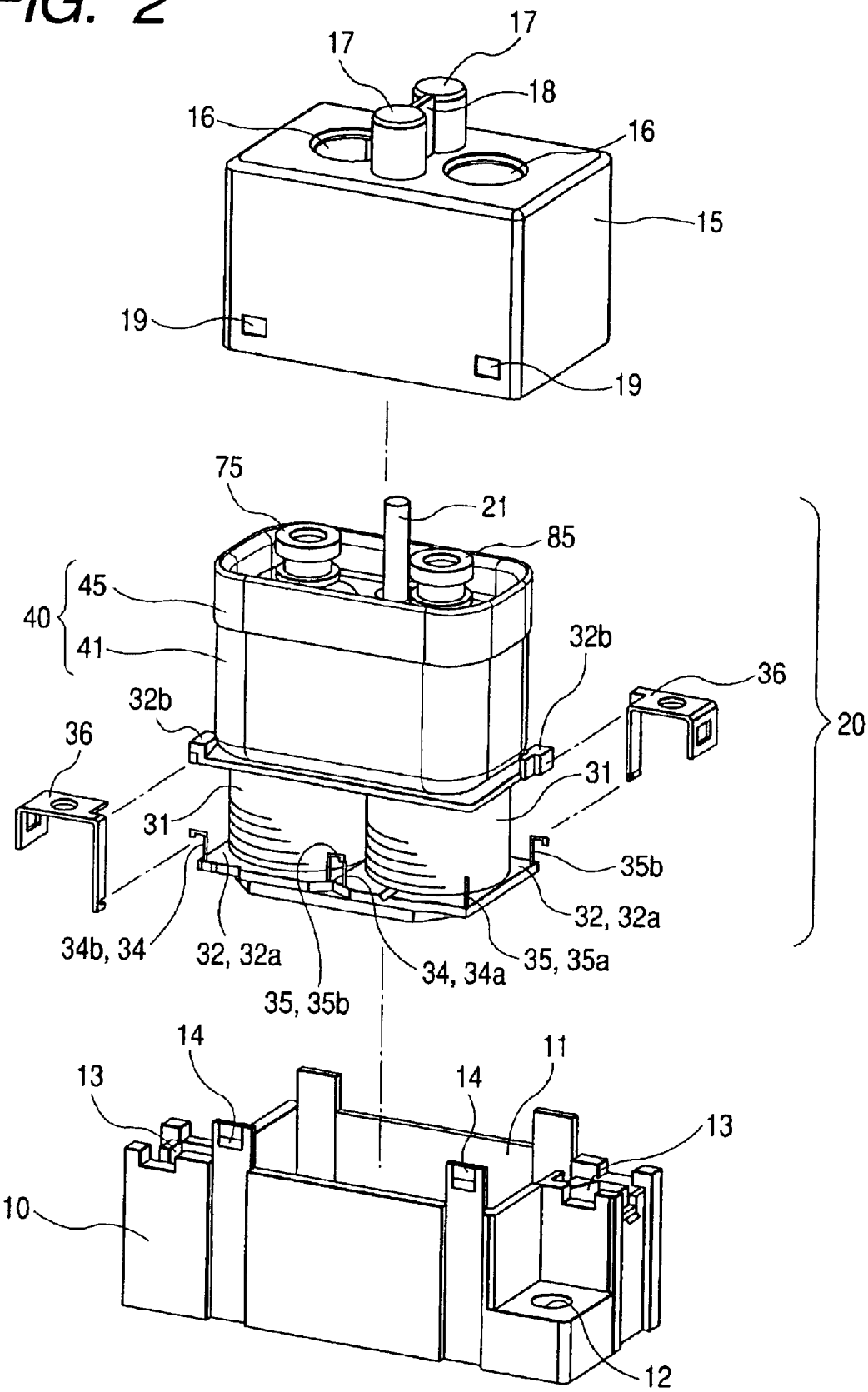
FIG. 2 is an exploded perspective view of FIG. 1.

The box-shaped case 10 is provided, as shown in FIG. 2, with: a recess 11 for housing a later-described electromagnet block 30; fixing through holes 12 in a pair of plane corners positioned on a diagonal line; and connecting recesses 13 positioned in the remaining plane corners. In the connecting recesses 13, connecting nats (not shown in the figure) are embedded.

The box-shaped cover 15 is so shaped that it can fit the box-shaped case 10 and can house a later-described sealing case block 40. In the ceiling of the box-shaped cover 15, moreover, there are formed connecting holes 16 and 16, from which there are protruded connecting terminals 75 and 85 of the relay body 20. From the ceiling of the box-shaped cover 15, moreover, there are protrusions 17 and 17 for housing a gas vent pipe 21. The protrusions 17 and 17 are connected through a partition wall 18 and have a function as an insulating wall together. By engaging engaged holes 19, which are formed in the edge portion of the lower opening of the box-shaped cover 15, with engaging pawls 14, which are formed on the edge portion of the upper opening of the box-shaped case 10, moreover, the cover 15 and the case 10 are integrally jointed to each other.

Figure 3:
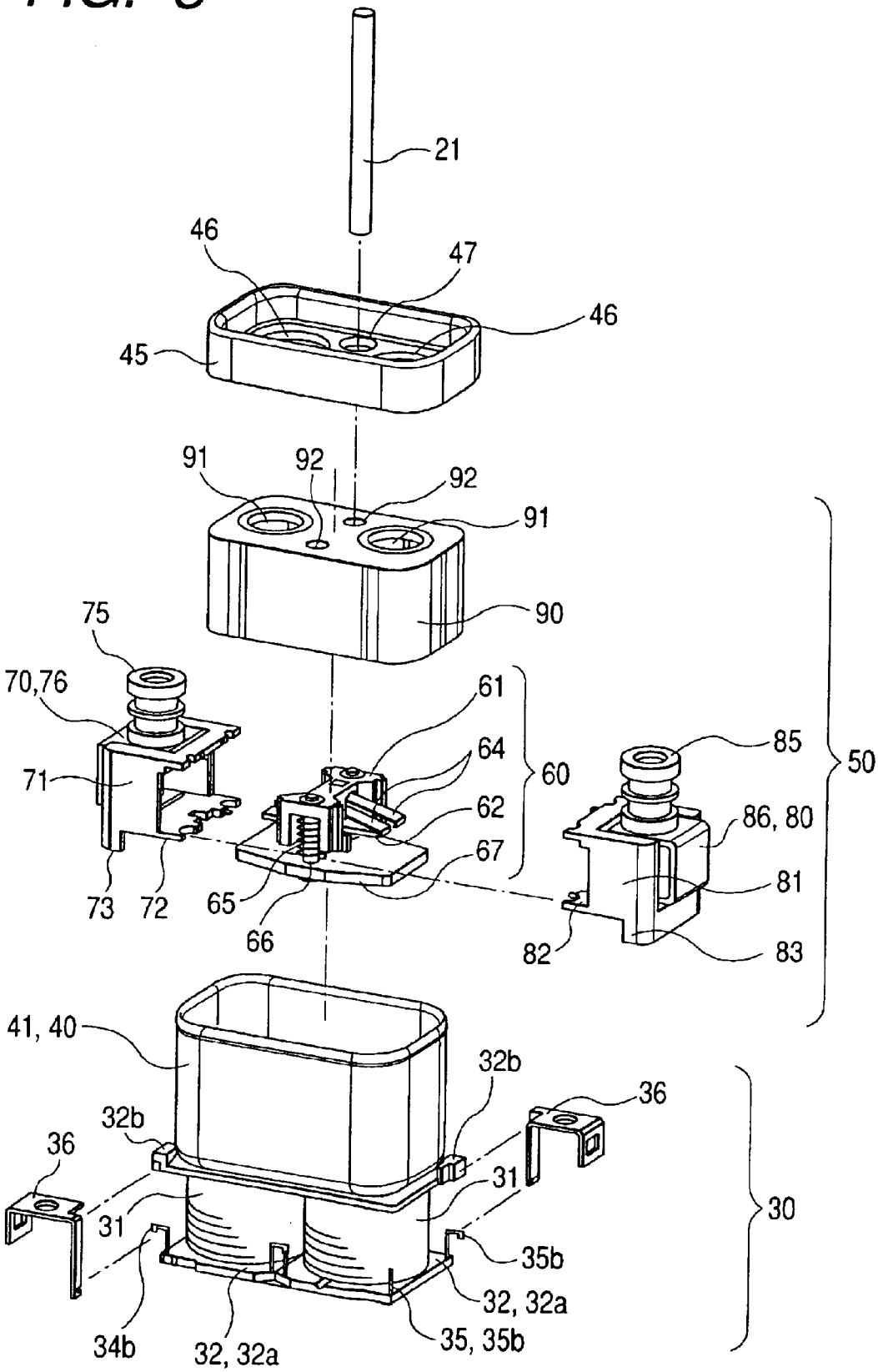
FIG. 3 is an exploded perspective view of a relay body shown in FIG. 2.
Figure 4:
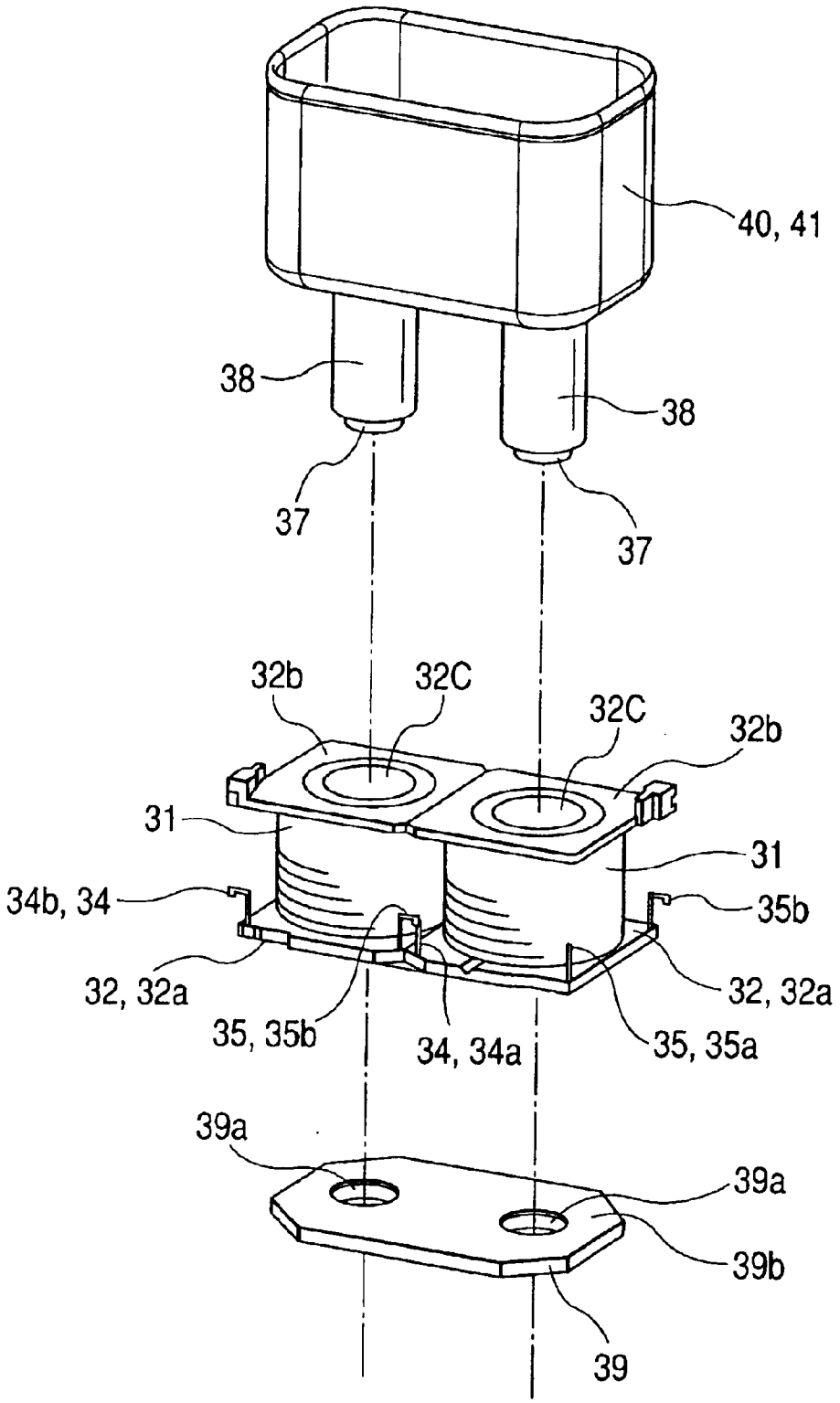
FIG. 4 is an exploded perspective view of an electromagnet block shown in FIG. 3.

In the relay body 20, as shown in FIG. 3, a contact mechanism block 50 is sealed in the sealing case block 40 mounted on the electromagnet block 30.

This electromagnet block 30 is so integrated that a pair of spools 32 wound with coils 31 are juxtaposed to each other around two iron cores 37 and through a yoke 39.

Relay terminals 34 and 35 are individually press-fitted on the two opposed side end faces of the lower one 32*a* of flange portions 32*a* and 32*b* at the two ends of the spools 32. And, the coil 31 wounded on the spools 32 is bound and soldered at its one-end portion to the one-end portion (or bind portions) 34*a* of one relay terminal 34 and is bound and soldered at its other end (bind portion) to one-end portion (or bind portion) 35*a* of the other relay terminal 35. In the relay terminals 34 and 35, moreover, not only the bind portions 34*a* but also other end portions (or joint portions) 35*b* are bent up. Of the relay terminals 34 and 35 assembled with the juxtaposed spools 32 and 32, the joint portion 35*b* of the relay terminal 35 and the bind portion 34*a* of the other relay terminal 34 are jointed and soldered to each other. Of the adjacent relay terminals 35 and 34, moreover, the bind portion 35*a* and a joint portion 34*b* are jointed and soldered to each other. Thus, the two coils 31 and 31 are connected. Moreover, the paired flange portions 32*a* and 32*b* of the spools 32 are individually spanned with coil terminals 36 and 36 and connected to the joint portions 34*b* and 35*b* of the relay terminals 34 and 35. (FIG. 3)

The sealing case block 40 is constructed to include a sealing case 41 capable of housing the later-described contact mechanism block 50, and a sealing cover 45 for sealing the opening of the sealing case 41. In the bottom face of the sealing case 41, there are formed a pair of press-fit holes 42 (FIG. 5) for press-fitting the icon cores 37. In the sealing cover 45, on the other hand, there are formed a pair of insert holes 46 and 46 capable of inserting the connecting terminals 75 and 85 of the later-described contact mechanism block 50, and a loosely fitting hole 47 capable of fitting the gas vent pipe 21 loosely.

The electromagnet block 30 and the sealing case 40 are assembled in the following procedure.

First of all, the relay terminals 34 and 35 are individually press-fitted in the flange portions 32*a* of the spools 32 whereas the coils 31 are wound on the spools 32, and the lead wires are individually bound on the soldered to the bind portions 34*a* and 35*a* of the relay terminals 34 and 35. Next, there are juxtaposed the paired spools 32, from which the bind portions 34*a* and 35*a* and the joint portions 34*b* and 35*b* of the relay terminals 34 and 35 are bent up. Moreover, the bind portion 35*a* of the relay terminal 35 and the joint portion 34*b* of the other relay terminal 34 are jointed and soldered to each other. Moreover, the coils 31 and 31 are connected by jointing and soldering the joint portion 35*b* of the relay terminal 35 and the bind portion 34*a* of the other relay terminal 34.

Figure 5:
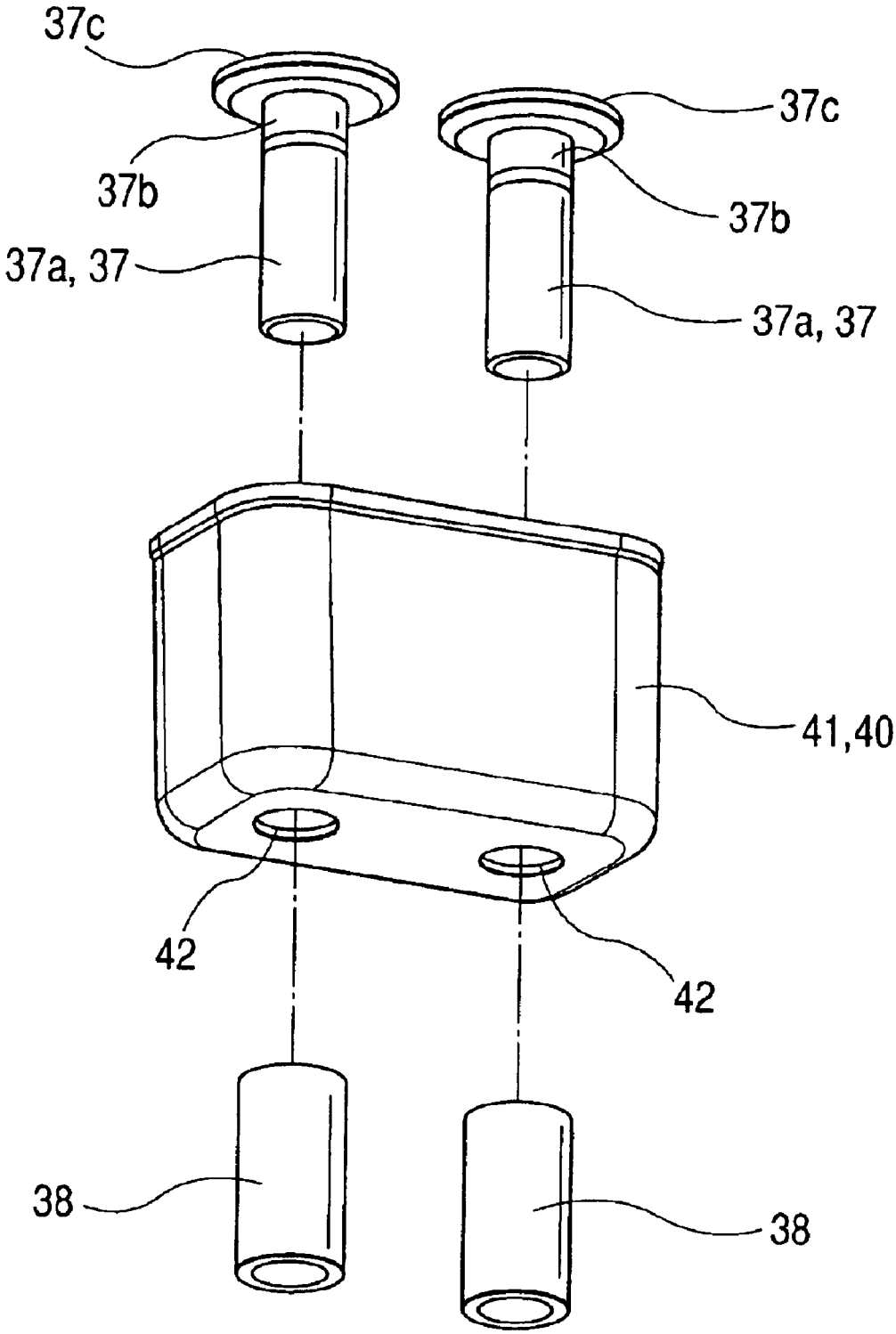
FIG. 5 is an exploded perspective view of a sealing case shown in FIG. 4.
Figure 6B:
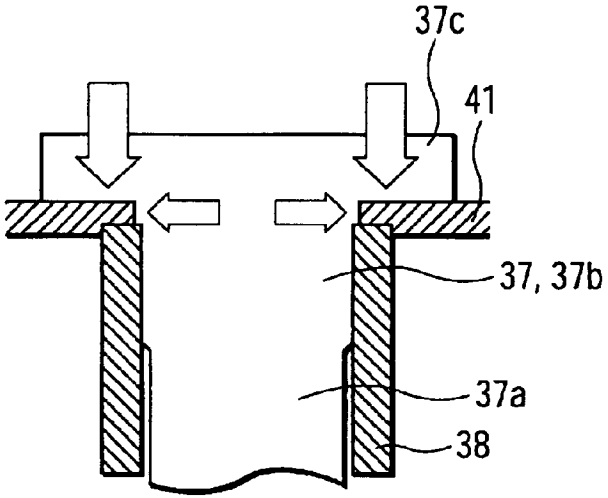
FIGS. 6A and 6B are enlarged sectional views showing a method for caulking the sealing case shown in FIG. 5.
Figure 6A:
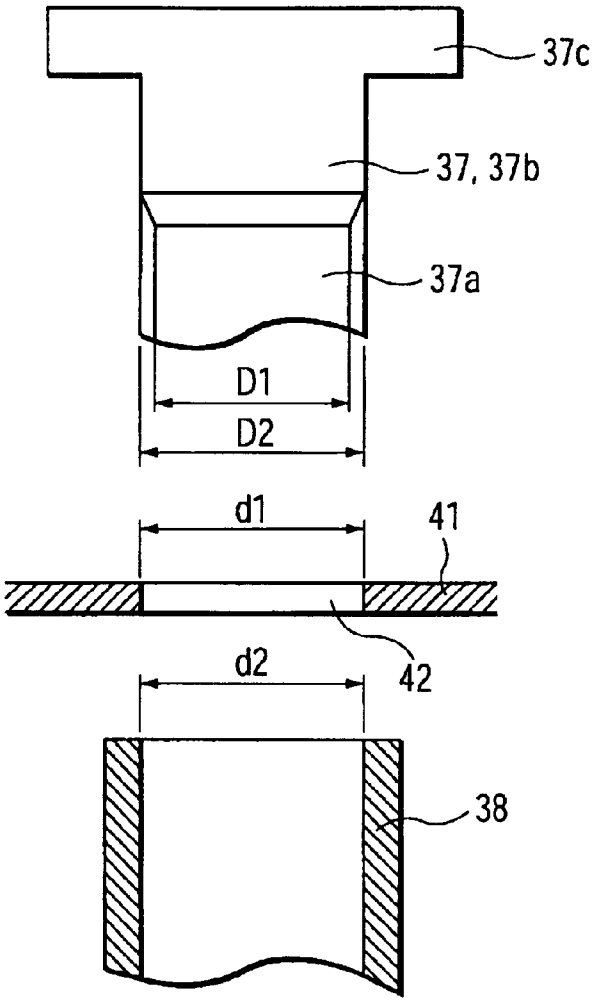

As shown in FIG. 5, on the other hand, the iron cores 37 are individually inserted into the press-fit holes 42 formed in the bottom face of the sealing case 41, and pipes 38 are fitted on the protruding stems 37*a* of the iron cores 37. And, the iron cores 37 are pushed in the axial direction from the open edge portions of the pipes 38. As shown in FIG. 6, the iron core 37 is made smaller at the diameter D1 of its stem portion 37*a* than the diameter d1 of the press-fit hole 42 of the sealing case 41 and the internal diameter d2 of the pipe 38. However, the diameter D2 of the neck portion 37*b* of the iron core 37 is made larger than the diameter d1 of the press-fit hole 42 of the sealing case 41 and the internal diameter d2 of the pipe 38. When the iron core 37 is pushed in the axial direction, the neck portion 37*b* of the iron core 37 is press-fitted in the press-fit hole 42 of the sealing case 41 while widening it and the internal diameter of the pipe 38. Moreover, the open edge portion of the pipe 38 and the head portion (or magnetic pole portion) 37*c* of the iron core 37 push the open edge portion of the press-fit hole 42 of the sealing case 41 from above and below. There, the open edge portion of the press-fit hole 42 of the sealing case 41 is caulked and fixed from the three sides.

According to this embodiment, the sealing case 41 is made of such a material, e.g., aluminum as has a larger coefficient of thermal expansion than those of the iron cores 37 and the pipes 38. Therefore, the embodiment is advantageous in that the gas-tightness is not deteriorated even if the temperature changes.

The reason for this advantage will be described in the following. Even if the temperature rises so that the individual parts expand, the expansion of the sealing case 41 in the thickness direction is larger than those of the remaining parts so that the sealing case 41 is firmly clamped between the head portions 37*c* of the iron cores 37 and the pipes 38. Even if the temperature drops so that the individual parts shrink, on the other hand, the shrinkage of the press-fit holes 42 of the sealing case 41 in the diametrical direction is larger than those of the remaining parts so that the sealing case 41 fastens the neck portions 37*b* of the iron cores 37.

In order to prevent the thermal stress while retaining the gas-tightness, it is preferred that the iron cores 37 and the pipes 38 have substantially equal coefficients of thermal expansion.

Then, the iron cores 37 and the pipes 38 are individually inserted into center holes 32*c* of the spools 32, and the leading end portions of the protruding iron cores 37 are inserted into and caulked by caulking holes 39*a* of the yoke 39. Thus, the electromagnet block 30 is completed while mounting the sealing case 41. Between the yoke 39 and the flange portions of the spools 32, there is sandwiched an insulating sheet 39*b* (FIG. 4) for enhancing the insulating performance.

Next, the paired flange portions 32*a* and 32*b* of the spools 32 are individually spanned with the coil terminals 36, and the lower end portions of these coil terminals 36 are jointed to the joint portions 34*b* and 35*b* of the relay terminals 34 and 35.

The contact mechanism block 50 is constructed, as shown in FIG. 3, to include a moving contact block 60, stationary contact blocks 70 and 80 assembled on the two sides of the moving contact block 60, and an insulating case 90 fitted to integrate those blocks 60, 70 and 80.

Figure 7A:
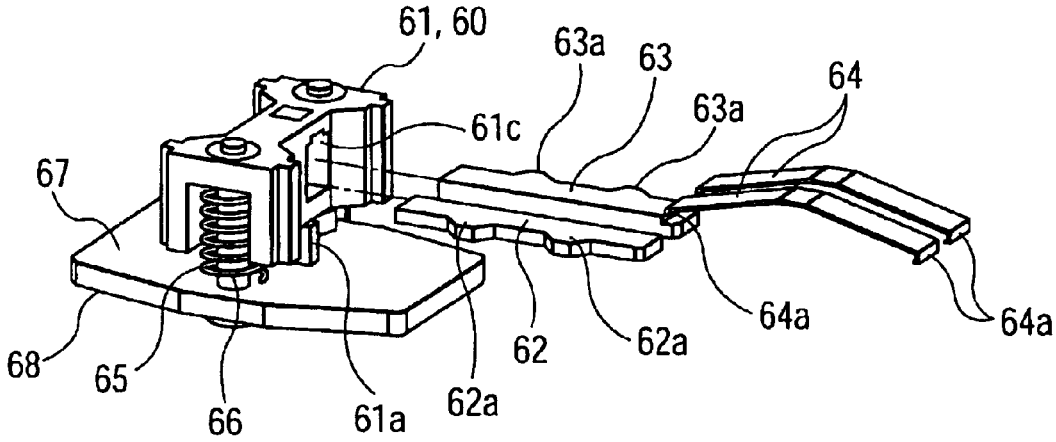
FIGS. 7A and 7B are exploded perspective views of a moving contact block shown in FIG. 3.
Figure 7B:
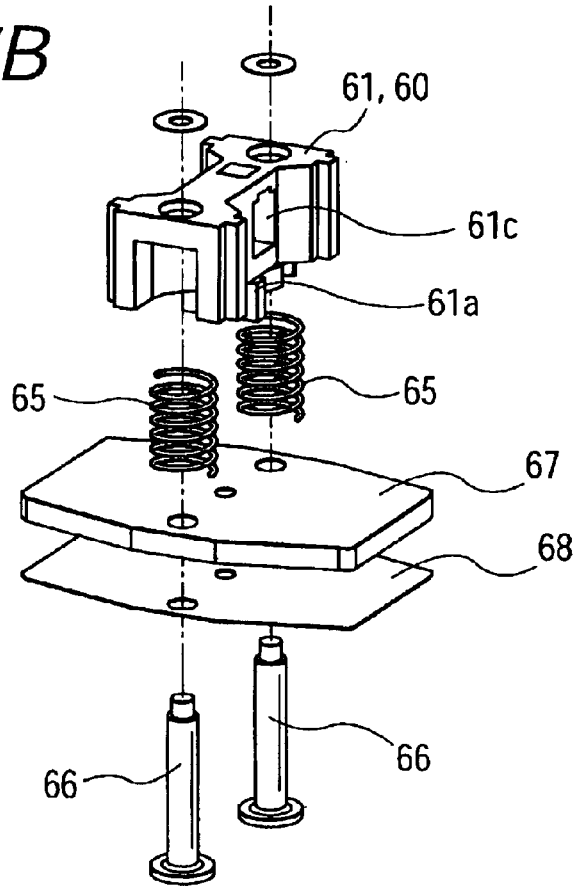

The moving contact block 60 is constructed, as shown in FIG. 7A, by assembling a pair of juxtaposed moving contact members 62 and 63 and contact springs 64 individually with a moving insulating bed 61. The moving insulating bed 61 is constructed, as shown in FIG. 7B, such that a leg portion 61*a* having a generally cross-shape section is protruded from the lower face of its central portion and such that a moving iron member 67 is caulked and fixed on its two side portions through rivets 66 having coiled return springs 65 fitted thereon. The moving iron member 67 is covered on its lower face with a shielding sheet 68.

A pair of retained protrusions 62*a* and 63*a* are individually protruded from the one-side edge portions of the band-shaped conductive materials of the moving contact members 62 and 63. Of the moving contact members 62 and 63, the moving contact member 62 is made of a band-shaped conductive member of molybdenum having a high melting point and capable of enduring a rush current, and the other moving contact member 63 is made of a thick band-shaped copper sheet plated with silver.

The contact springs 64 are arranged for applying a contact pressure to the moving contact members 62 and 63. And, the contact springs 64 are made by bending band-shaped spring materials generally into an angle shape and are folded at their two side edge portions to form retained pawls 64*a* and 64*a*.

These retained pawls 64*a* of the contact springs 64 are retained on the two end portions of the moving contact members 62 and 63, when the moving contact members 62 and 63 and the contact springs 64 and 64 are inserted into and assembled with a pair of assembling holes 61*b* and 61*c* juxtaposed in the moving insulating bed 61. As a result, the moving contact members 62 and 63 can be prevented from becoming vertically loose. Moreover, the retained protrusions 62*a* and 63*a* of the moving contact members 62 and 63 are retained on the open edge portions of the assembling holes 61*b* and 61*c* of the moving insulating bed 61, so that the contact springs 64 and the moving insulating beds 62 and 63 can be prevented from coming out. By positioning the moving contact member 62 at a lower height than that of the moving contact member 63, moreover, a step is formed between the paired moving contact members 62 and 63. As a result, the moving contact member 62 comes into contact with a stationary contact 78*a* before the moving contact member 63 comes into contact with a stationary contact 78*b*.

Figure 8A:
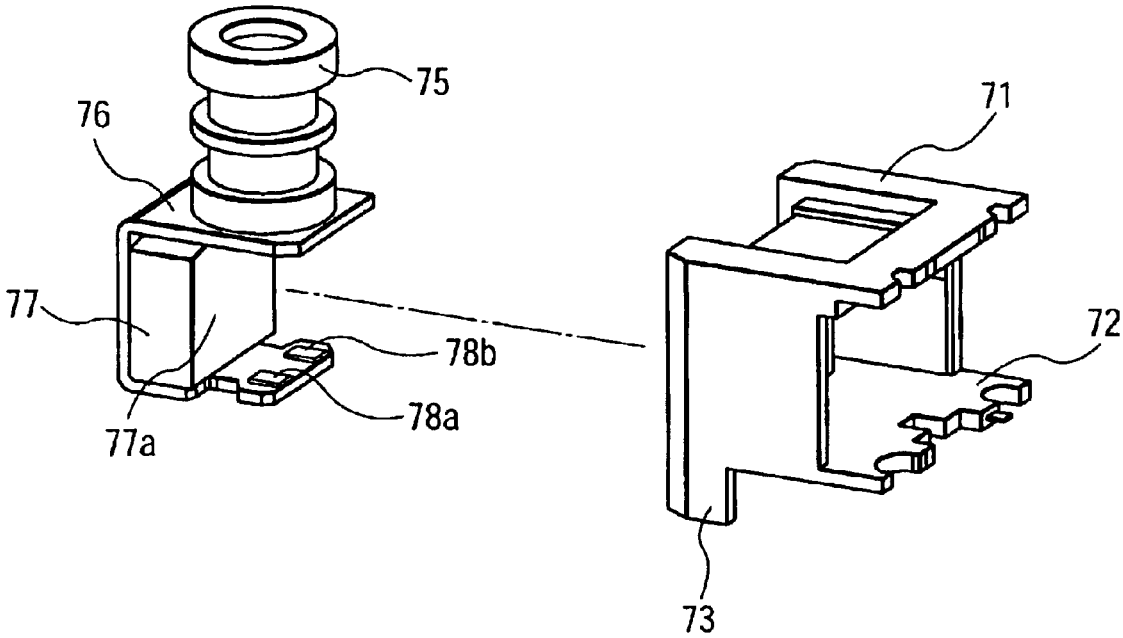
FIGS. 8A and 8B are exploded perspective views of a stationary contact block shown in FIG. 3.
Figure 8B:
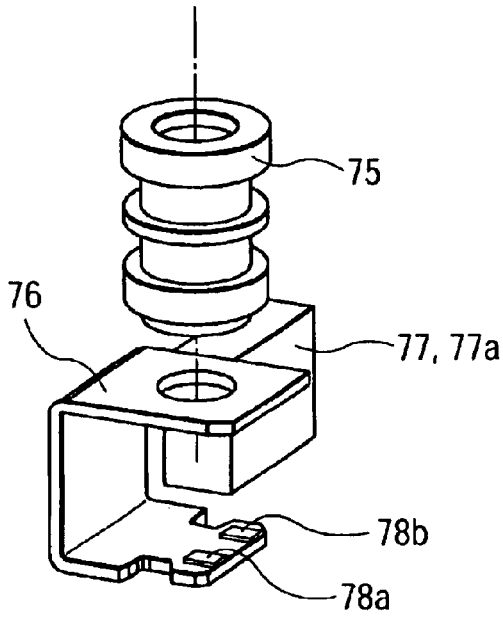
Figure 9A:
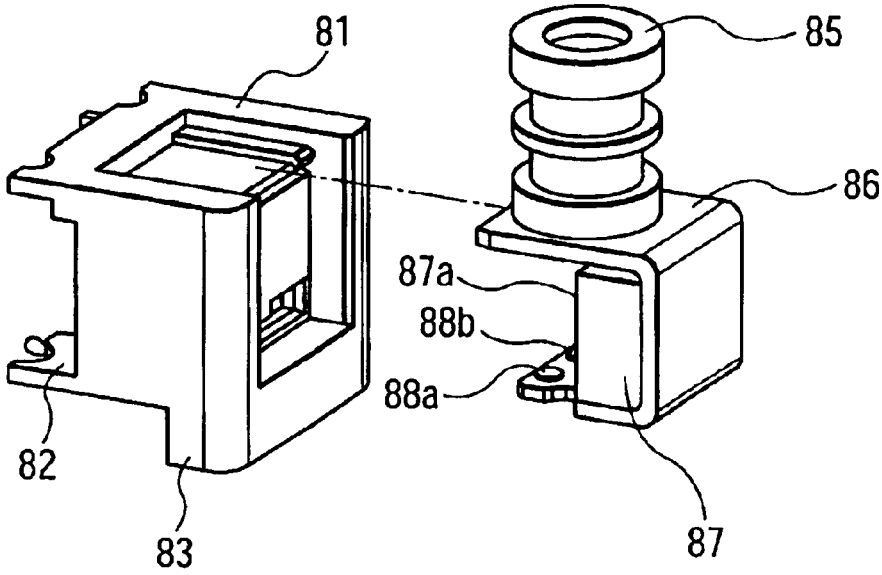
FIGS. 9A and 9B are exploded perspective views of the stationary contact block shown in FIG. 3.
Figure 9B:
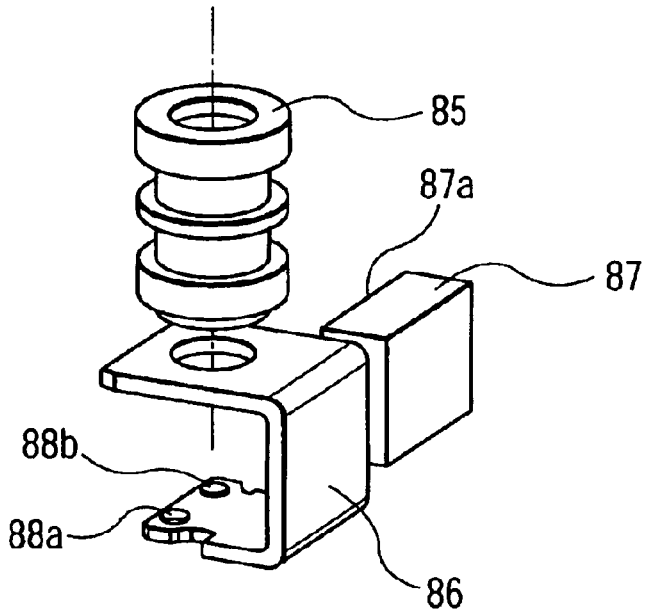
Figure 10:
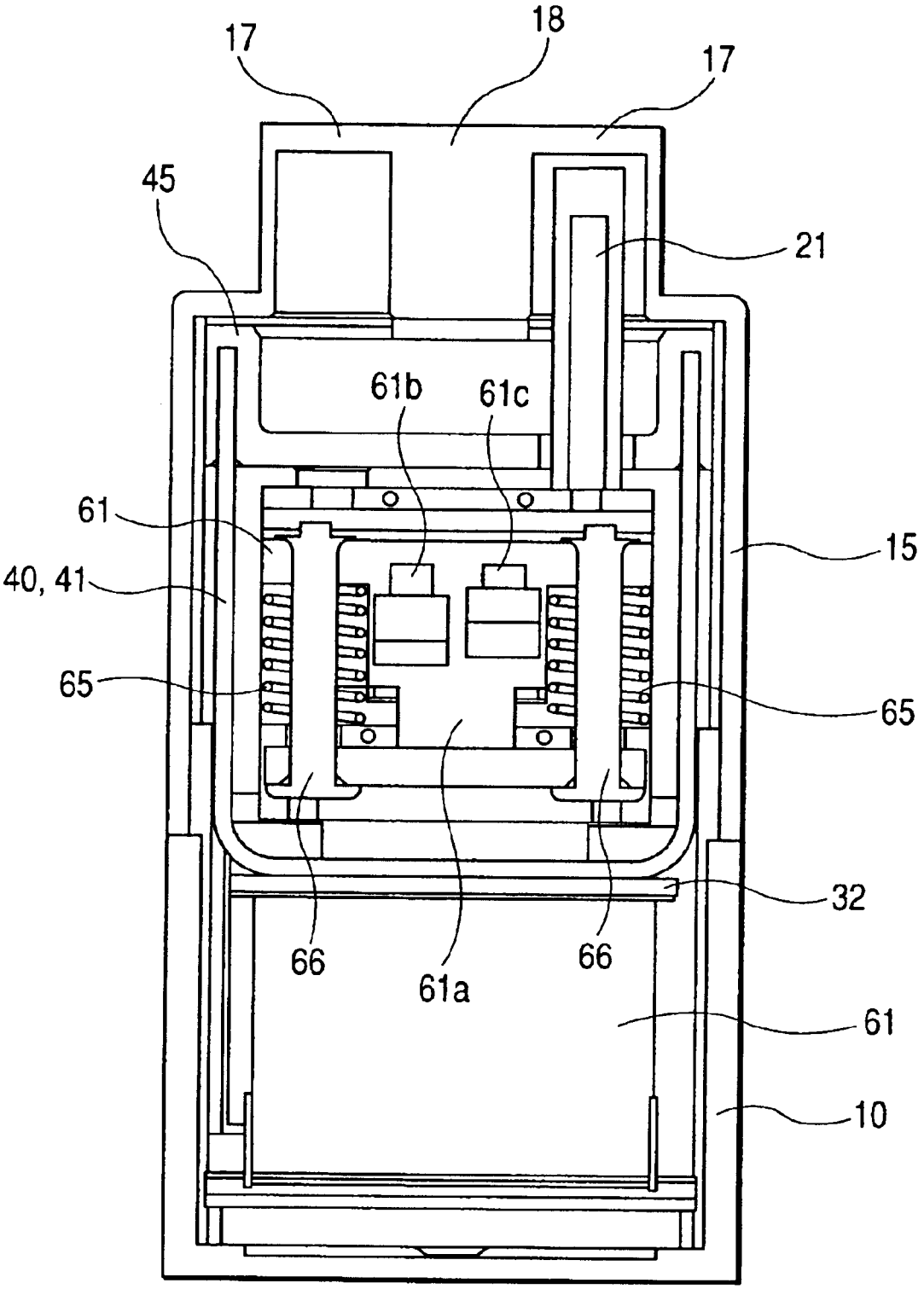
FIG. 10 is a longitudinal section of the switching device shown in FIG. 1.
Figure 11A:
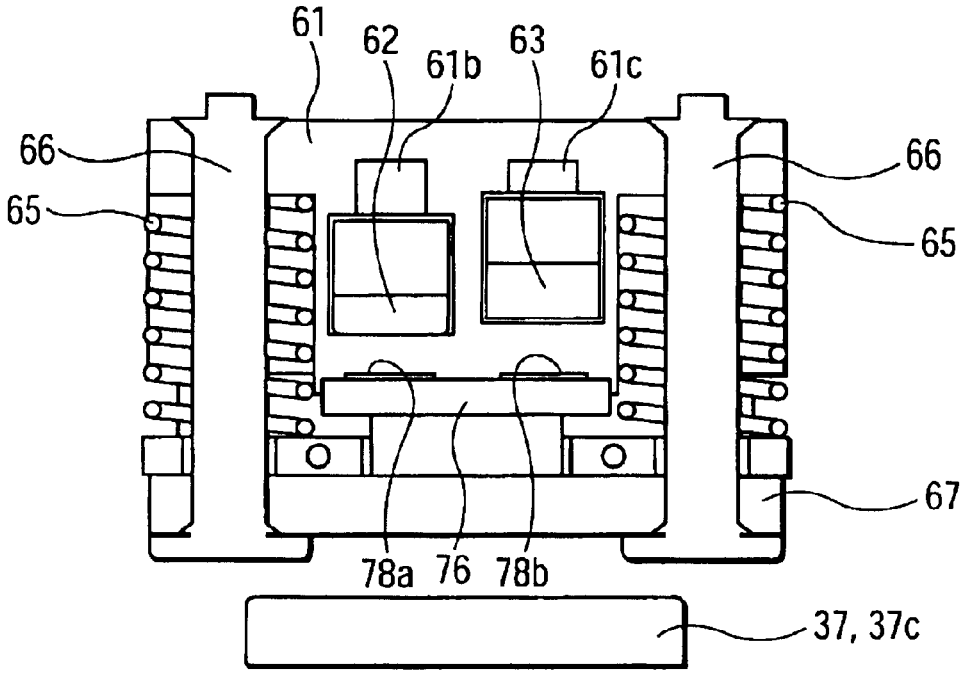
FIGS. 11A and 11B are partially enlarged sectional views of FIG. 10.
Figure 11B:
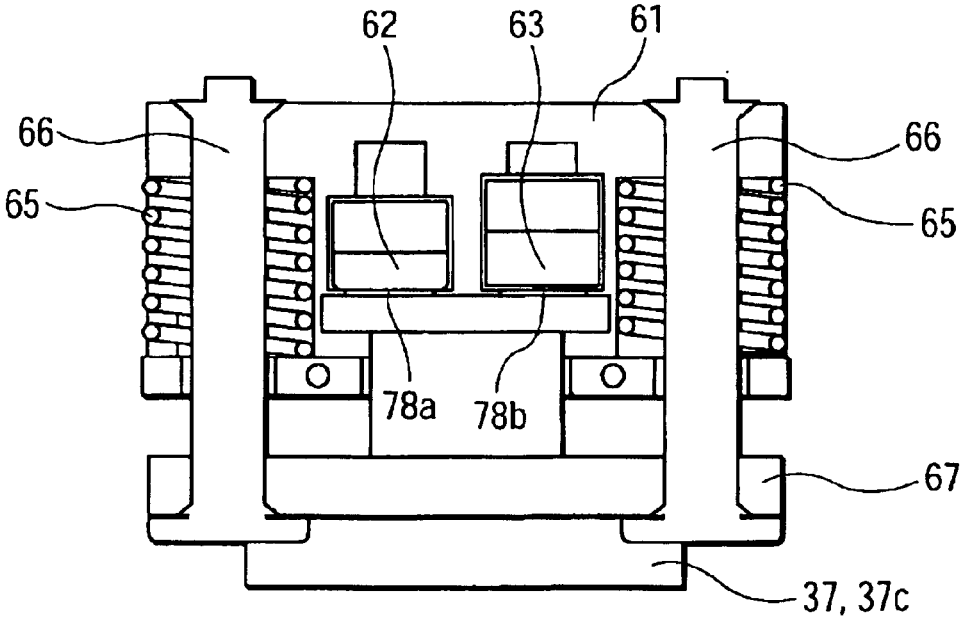
Figure 12:
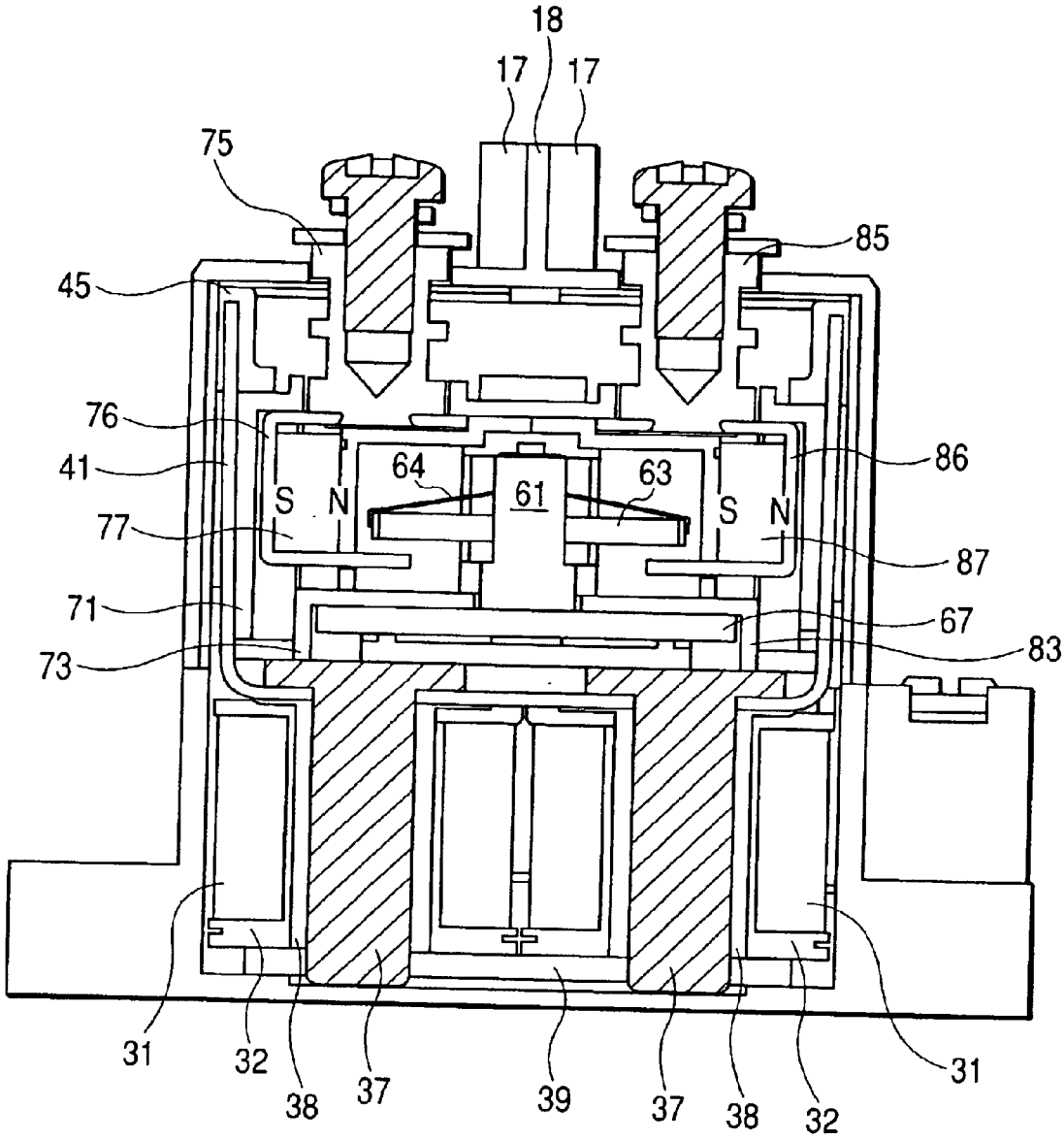
FIG. 12 is a longitudinal section showing the relay of the embodiment according to the invention and taken at a different angle.

The stationary contact blocks 70 and 80 are constructed, as shown in FIG. 8 and FIG. 9, such that stationary contact beds 71 and 81 molded of a resin to have an identical shape are assembled with stationary contact terminals 76 and 86, as made of a generally C-shaped section caulking and fixing the connecting terminals 75 and 85, and permanent magnets 77 and 87. The stationary contact beds 71 and 81 are constructed such that abutting protrusions 72 and 82 are individually protruded inward sideways and such that supporting leg portions 73 and 83 are individually protruded vertically downward.

The stationary contact terminals 76 and 86 are formed to have pairs of stationary contacts 78*a* and 78*b*, and 88*a* and 88*b*, respectively, by protruding their lower side edge portions. On the other hand, the permanent magnets 77 and 87 are assembled such that their pole-faces 77*a* and 87*a* are jointed to the inner faces of the stationary contact terminals 76 and 86. As a result, the pole-faces 77*a* and 87*a* of the permanent magnets 77 and 87 are positioned near the paired stationary contacts 78*a* and 78*b*, and 86*a* and 86*b*.

The insulating case 90 is provided for uniting the contact mechanism block 50, as shown in FIG. 3. And, the paired stationary contact blocks 70 and 80 are assembled from the two sides with the moving contact block 60 and are then fitted thereon, so that the connecting terminals 75 and 85 are protruded from terminal holes 91 and 91 of the insulating case 90. This insulating case 90 is provided with a pair of gas vent holes 92 near the terminals holes 91. The reason for the paired gas vent holes 92 is to eliminate the directivity at the assembling time.

Here will be described the procedure for assembling the contact mechanism block 50.

At first, the moving iron member 67 and the shielding sheet 68 are assembled with the moving insulating bed 61 through the rivets 66 inserted into the return springs 65. And, the moving contact members 62 and 63 and the contact springs 64 and 64 are assembled with the moving insulating bed 61. Next, the stationary contact blocks 70 and 80 are assembled from the two sides of the moving insulating bed 61 while raising the lower end sides of the return springs 65, thereby to bringing the abutting protrusions 72 and 82 into abutment against each other. Moreover, the insulating case 90 is fitted on the stationary contact blocks 70 and 80. Thus, the contact mechanism block 50 is completed.

Next, the contact mechanism block 50 is inserted into the sealing case 41 mounted on the electromagnet block 30. Then, the leg portions 73 and 83 of the stationary contact blocks 70 and 80 abut against the head portions 37*c* or the magnetic pole portions of the iron cores 37 so that the moving iron member 67 can come close to and apart from the magnetic pole portions 37*c* through the shielding sheet 68. And, the sealing cover 45 is fitted in and welded integrally with the sealing case 41. Moreover, the gas vent pipe 21 is press-fitted from the loosely fitting hole 47 into the gas vent hole 92 of the insulating case 90. Next, a sealing material (although not shown) is injected onto the sealing cover 45 and is solidified to seal around the base portions of the connecting terminals 75 and 85 and the gas vent pipe 21. And, the air in the sealing case 40 is vented from the gas vent pipe 21, and a predetermined mixture gas is injected. After this, the gas vent pipe 21 is caulked and sealed. And, the paired flange portions 32*a* and 32*b* of the spools 32 are spanned with the coil terminals 36. Thus, the relay body 20 is completed.

And, this relay body 20 is housed in the recess 11 of the case 10, and the coil terminals 36 are arranged in the connecting recesses 13. Moreover, the cover 15 is assembled with the case 10. Thus, the DC current breaking relay is completed.

Here will be described the actions of the relay thus constructed.

First of all, in case no voltage is applied to the coils 31 of the electromagnet block 30, the moving insulating bed 61 is pulled up (FIG. 13A) by the spring forces of the return springs 65 and 65. As a result, the moving iron member 67 leaves the magnetic pole portions 37*c* of the iron cores 37, and the two end portions of the moving contact members 62 and 63 leave the stationary contacts 78*a* and 88*a*, and 78*b* and 88*b*, respectively.

Figure 13A:
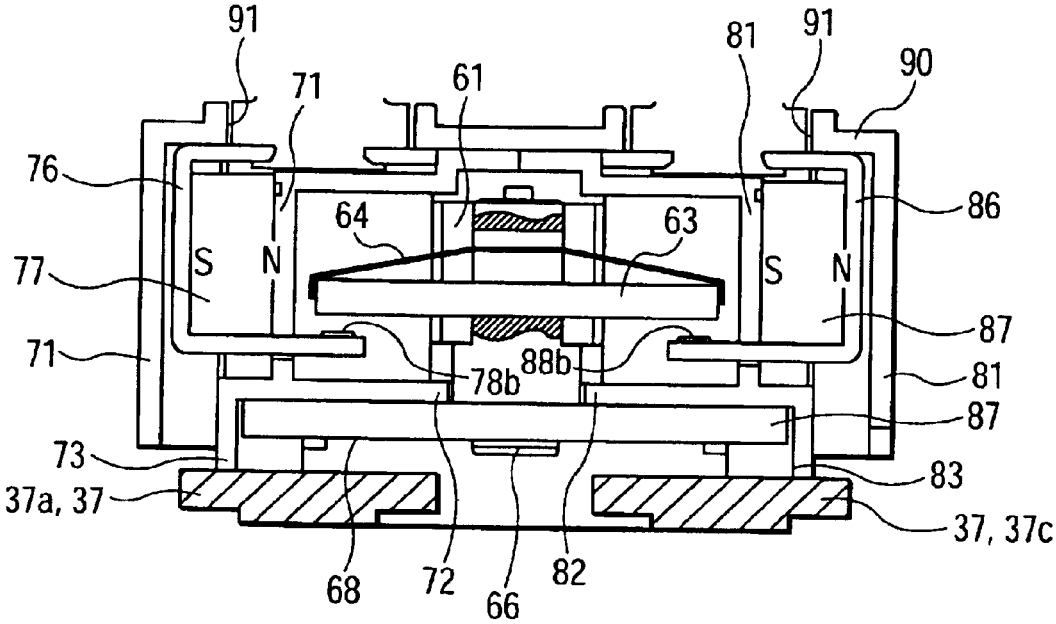
FIGS. 13A and 13B are partially enlarged views of FIG. 12.
Figure 13B:
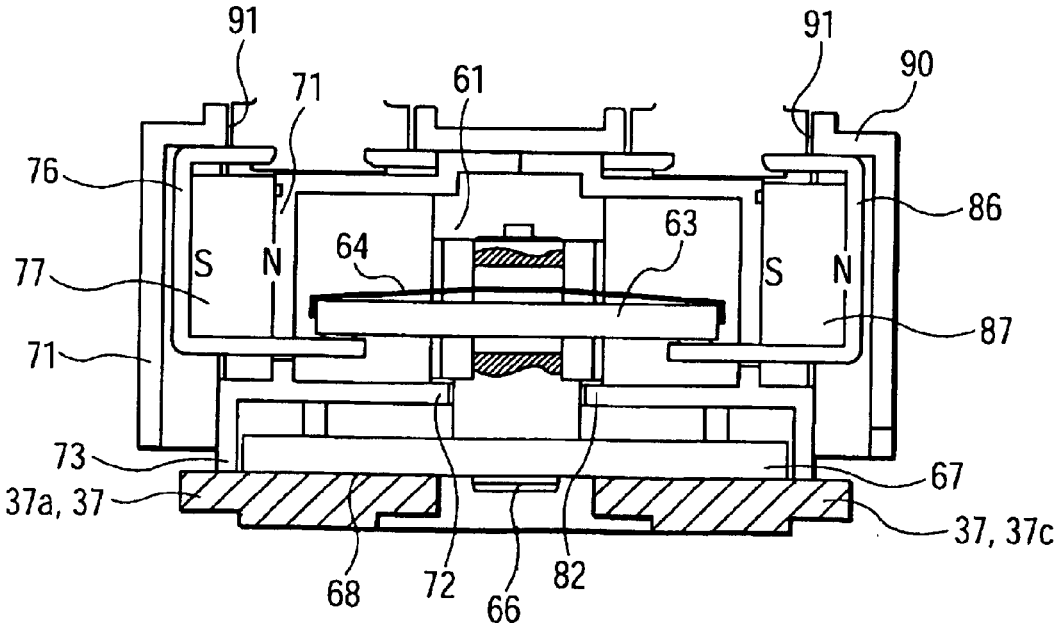
Figure 14:
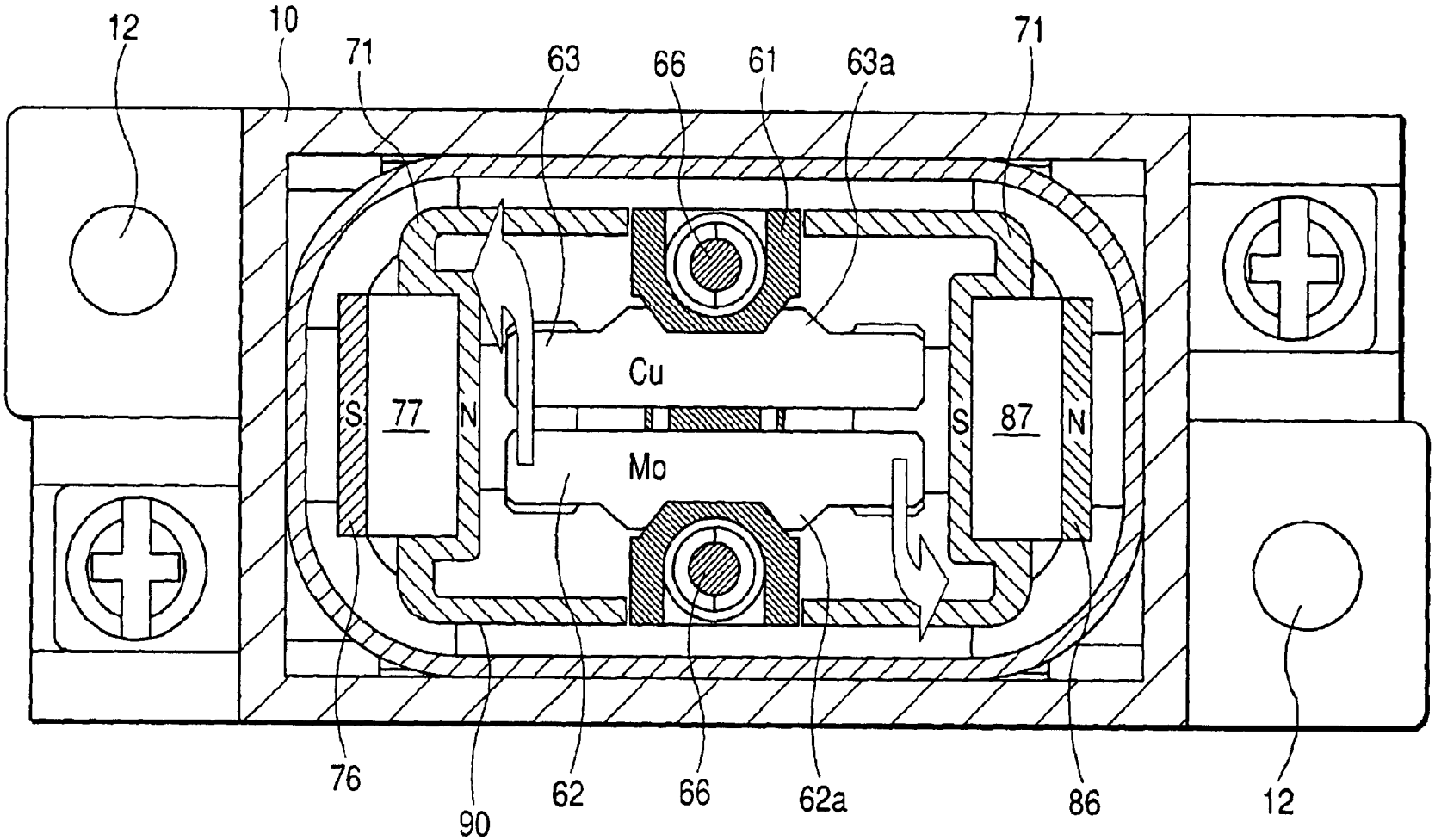
FIG. 14 is a transverse section of the switching device shown in FIG. 1.

When a voltage is applied to the coils 31, moreover, the magnetic pole portions 37*c* of the iron cores 37 attract the moving iron member 67 so that the moving iron member 67 moves downward against the spring forces of the return springs 65. As a result, the moving insulating bed 61, as integrated with the moving iron member 67, moves downward so that the two end portions of the moving contact member 62 come into contact with the stationary contacts 78*a* and 88*a*. Next, the two end portions of the moving contact member 63 come into contact with the stationary contacts 78*b* and 88*b* so that the moving iron member 67 is attracted by the magnetic pole portions 37*c* of the iron cores 37 (FIG. 13B).

Next, when the application of the voltage to the coils 31 is interrupted, the moving insulating bed 61 is pushed upward by the spring forces of the return springs 65 so that the moving iron member 67 leaves the magnetic pole portions 37*a* of the iron cores 37 together with the moving insulating bed 61. After the two end portions of the moving contact member 63 left the stationary contacts 78*b* and 88*b*, moreover, the two end portions of the moving contact member 62 leave the stationary contacts 78*a* and 88*a*.

An arc current, if produced when the two end portions of the moving contact member 62 leave the stationary contacts 78*a* and 88*a*, is attracted and broken by the magnetic forces of the permanent magnets 77 and 87. This point will be described in detail with reference to FIG. 14 and FIG. 15.

Figure 15:
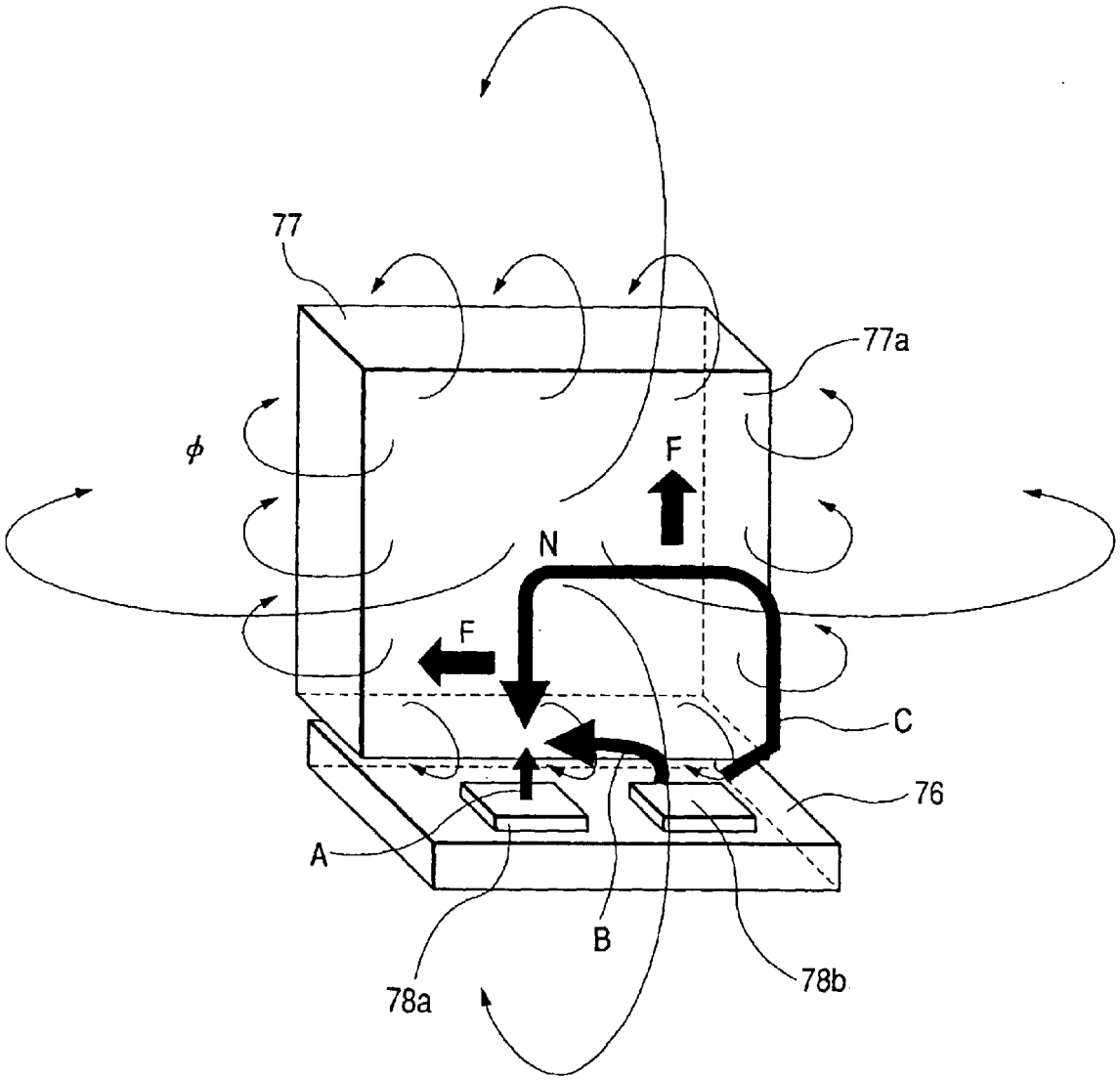
FIG. 15 is a schematic diagram showing an ark breaking mechanism according to an embodiment of the invention.

As shown in FIG. 15, for example, the magnetic flux of the permanent magnet 77 is emitted, as indicated by arrows, from the pole-face 77*a*. When the moving iron member 67 returns, moreover, the end portion of the moving contact member 63 leaves the stationary contact 78*b*, and the end portion of the moving contact member 62 leaves the stationary contact 78*a*. As a result, an arc current A begins to build up from the stationary contact 78*a*. According to Freming's left-hand law (or by the Lorentz's force), however, the arc current A is attracted by the magnetic force of the permanent magnet 77, and it shifts its production place to the stationary contact 78*b* and turns into an arc current B. Moreover, this arc current B is extended into an arc current C by the magnetic force of the permanent magnet 77 so that it is finally cut and broken.

In this embodiment, the arc current is so extended on the basis of the Freming's left-hand law as to whirl along the pole-faces 77*a* and 87*a* of the permanent magnets 77 and 87, until it is broken. Therefore, a large space is not required for breaking the arc current unlike the examples of the prior art, so that the device can be small-sized.

This embodiment has been described on the case, in which the DC current is broken, but may be applied to the case in which an AC current is broken. It is natural that the embodiment can also be applied not only to the relay but also to a switch, a timer or the like.

According to the invention, the moving iron member of the contact mechanism block contacts with the magnetic pole portions or the one-end portions of the paired iron cores constructing the electromagnet block, and the end portions of the iron cores are connected by the yoke. As a result, a magnetic circuit, as continued by the paired iron cores, the yoke and the moving iron member, is formed to bring about an effect that the switching device obtained has a low magnetic resistance and a small power consumption.

What is claimed is:

1. A switching device comprising: a contact mechanism block housed in a closed sealing case; and an electromagnet block arranged outside of said sealing case for driving said contact mechanism block, wherein a pair of iron cores constructing said electromagnetic block have their one-end magnetic pole portions individually arranged on the bottom face of said sealing case and their other end portions connected to each other by a yoke, so that the two end portions of moving iron member of said contact mechanism block are attracted by and leave the magnetic pole portions of said iron cores as said electromagnet block is magnetized and demagnetized.

2. A switching device according to claim 1, wherein neck portions formed just below the magnetic pole portions of said iron cores are press-fitted in press-fit holes formed in the bottom face of said sealing case, wherein said press-fit holes are clamped at their open edge portions between the open edge portions of cylindrical members press-fitted on said neck portions, and wherein said sealing case is made of a material having a larger coefficient of thermal coefficient than that of said iron cores.

* * * * *